US008708109B2

(12) United States Patent
Steele et al.

(10) Patent No.: US 8,708,109 B2
(45) Date of Patent: Apr. 29, 2014

(54) CONTINUOUS ASSIST ZIPLINE BRAKING AND CONTROL SYSTEM

(75) Inventors: Charles Z. Steele, Whistler (CA); David E. Udow, Whistler (CA); Robert L. Steele, Winnipeg (CA)

(73) Assignee: Ziptrek Ecotours Inc., Whistler (CA)

( * ) Notice: Subject to any disclaimer, the term of this patent is extended or adjusted under 35 U.S.C. 154(b) by 325 days.

(21) Appl. No.: 12/666,648

(22) PCT Filed: Jun. 26, 2007

(86) PCT No.: PCT/CA2007/001138
§ 371 (c)(1),
(2), (4) Date: Jun. 25, 2010

(87) PCT Pub. No.: WO2009/000059
PCT Pub. Date: Dec. 31, 2008

(65) Prior Publication Data
US 2011/0162917 A1 Jul. 7, 2011

(51) Int. Cl.
*B61H 9/02* (2006.01)
*B61H 9/06* (2006.01)

(52) U.S. Cl.
USPC ..... 188/65.3; 188/65.2; 104/113

(58) Field of Classification Search
USPC ..... 188/65.1, 65.2, 65.3, 65.4, 135, 138, 188/180, 188; 182/10, 11, 192, 193; 104/117.1, 112, 113, 115, 173.1, 202, 104/204; 472/49
See application file for complete search history.

(56) References Cited

U.S. PATENT DOCUMENTS

| | | | | |
|---|---|---|---|---|
| 1,859,180 | A | | 5/1932 | Thiel |
| 3,221,666 | A | * | 12/1965 | Wengel ..... 104/173.1 |
| 3,827,368 | A | | 8/1974 | Garnier |
| 4,474,263 | A | * | 10/1984 | Christopher ..... 182/10 |
| 4,934,277 | A | | 6/1990 | Smith et al. |
| 4,961,385 | A | | 10/1990 | Abouzakhm |
| 5,224,425 | A | | 7/1993 | Remington |
| 5,224,426 | A | * | 7/1993 | Rodnunsky et al. ..... 104/117 |
| 5,660,113 | A | | 8/1997 | Lehotsky |
| 6,666,773 | B1 | | 12/2003 | Richardson |
| 2002/0162477 | A1 | | 11/2002 | Palumbo |
| 2006/0027134 | A1 | | 2/2006 | Steele et al. |

FOREIGN PATENT DOCUMENTS

WO 2004035164 4/2004

OTHER PUBLICATIONS

"Vacationers to Costa Rica should check first with their tour operators' lawyers" by Gary Stix, Scientific American, Mar. 22, 2004.

* cited by examiner

*Primary Examiner* — Thomas J Williams
(74) *Attorney, Agent, or Firm* — Oyen Wiggs Green & Mutala LLP

(57) ABSTRACT

A continuous assist braking and control system (10) operable to control the movement, speed and acceleration of a zipline rider (32) traversing a zipline (12). A brake line (40) is entrained around first and second reels (50, 52), and suspended above the zipline (12). The rider (32) is tethered to the brake line (40). A brake (56) is coupled to at least one of the reels (50, 52). When the brake (56) is disengaged, the brake line (40) is pulled along with the rider (32) as the rider (32) traverses the zipline 12). When the brake (56) is engaged, the reels' rate of rotation is slowed, thereby slowing the brake line (40) and the rider (32). When the brake (56) is engaged to stop the reels' rotation, the brake line (40) is brought to a stop, thereby arresting the motion of rider (32).

42 Claims, 6 Drawing Sheets

CONTINUOUS ASSIST ZIPLINE BRAKING AND CONTROL SYSTEM

TECHNICAL FIELD

This invention relates to control and braking of riders traversing a zipline.

BACKGROUND

"Ziplines" are gravity-based cable rides generally used to transport people for various purposes including recreational thrill rides, forest canopy tours, and challenge courses. A typical zipline includes a stranded steel wire cable or fibre rope suspended between two supports, platforms at each support for launching and landing riders, and pulley blocks and harnesses to support and transport riders along the cable.

FIG. 1 depicts a typical zipline system in which wire rope main cable 12 is suspended between supports 14, 18 which may be constructed of wood, steel, aluminum or any other structurally suitable material. Trees, boulders or cliffs may alternatively function as supports 14, 18. Launch platform 16 is constructed on or surrounding support 14, and landing platform 20 is constructed on or surrounding support 18. Either or both of platforms 16, 20 may be (and typically are) fixed or mounted at elevated locations on supports 14, 18 respectively. Each platform 16, 20 may be equipped with a ramp or steps 28 to assist in launching and landing of riders. Platforms 16, 20 are typically also equipped with suitable safety railings and access control gates. Platforms 16, 20 may be suspended relative to supports 14, 20 to facilitate raising or lowering of platforms 16, 20 (e.g. via suitable motorized winches) in order to periodically adjust the tension of cable 12. Overhead supports 17, 21, are optionally mounted to supports 14, 18, respectively.

Rider 32 begins by donning harness 33 supplied by the zipline operator. Harness 33 includes a short primary tether 34 and an optional back-up safety tether 35 (FIG. 2) both of which are securely fastened to pulley block 30. After donning harness 33, rider 32 ascends launch platform 16, where the zipline operator's personnel couple pulley block 30 to cable 12, such that pulley block 30 may roll smoothly along cable 12. Rider 32 is released under the control of the zipline operator's personnel. More particularly, pulley block 30 rolls along cable 12 toward landing platform 20 (i.e. from left to right as viewed in FIG. 1) with rider 32 suspended beneath cable 12 by harness 33 and tether 34.

Rider 32 must reach and be braked and arrested at landing platform 20. If rider 32 is not properly braked upon arrival at landing platform 20, the moving rider may collide with support 18, with landing platform 20 or with persons or objects thereon. If rider 32's motion is not properly arrested upon arrival at landing platform 20, rider 32 may roll back down to the nadir of cable 12. Similarly, if rider 32 is not carried along cable 12 with sufficient velocity, rider 32 may slow down, stop short of landing platform 20, and roll back down to the nadir of cable 12. In either case, the zipline operator's personnel must rescue rider 32 from the nadir of cable 12. The rescue technique is well known and straightforward, and need not be described here. But, to avoid potentially timeconsuming and somewhat labour intensive rescue operations, the slope of cable 12 (the vertical distance between platforms 16, 20), the cable's sag (the vertical distance between cable 12 at mid-span and a chord drawn between supports 14, 18) and the cable's tension are adjusted to achieve a reasonable transit time at sufficient velocity along cable 12 to enable rider 32 to reach landing platform 20.

If the zipline is particularly steep, the rider's speed may be quite high, necessitating control of the rider's speed as well as effective braking of the rider. In some cases it is desirable to control a rider's movement throughout the ride, including the capability to brake and stop the rider at any point throughout the ride. Suitable apparatus and techniques for controlling the movement, speed and acceleration of a zipline rider are discussed below.

The foregoing examples of the related art and limitations related thereto are intended to be illustrative and not exclusive. Other limitations of the related art will become apparent to those of skill in the art upon a reading of the specification and a study of the drawings.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense. As used herein and as indicated by the arrows having outlined (unfilled) heads in FIGS. 1 and 2, "forward," "forwardly," "forwardmost" mean a direction which is longitudinally closer to landing platform 20 approached by rider 32 traversing cable 12. "Rearward", "rearwardly", "rearwardmost" mean a direction which is longitudinally farther from landing platform 20. "Rider" means a zipline rider and may include multiple zipline riders suspended beneath a pulley block in tandem.

Figure 1:
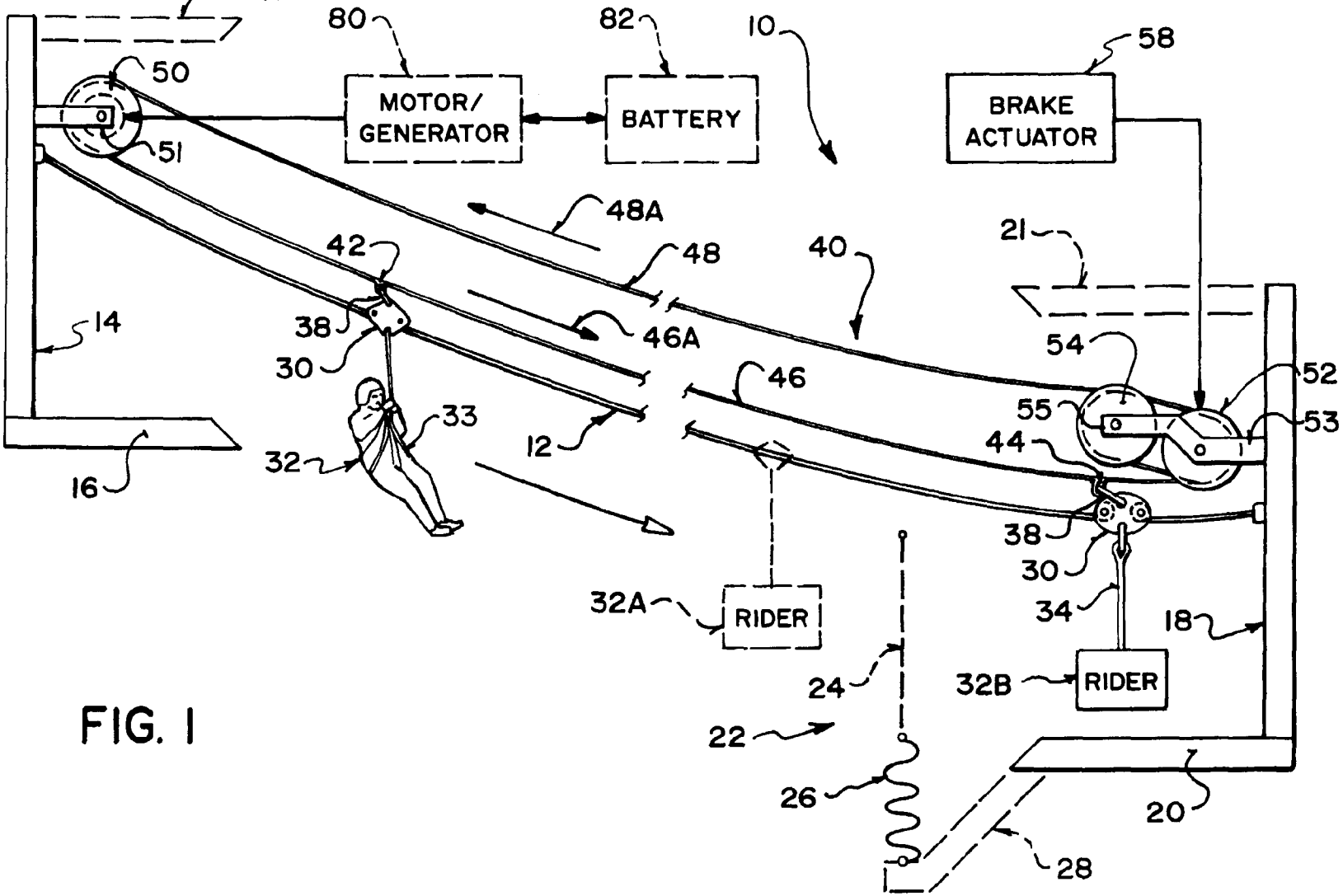
FIG. 1 is a partially fragment side view of a zipline showing the supports, the launch and landing platforms, the main cable, and an endless loop braking and control system.

FIG. 1 depicts a continuous assist braking and control system 10. Rider 32 is tethered to a point on a moving brake line 40 which parallels main cable 12. Various ways of tethering rider 32 to brake line 40 are described below. By controlling the movement, speed and acceleration (or deceleration) of brake line 40, a zipline operator may control the movement, speed and acceleration (or deceleration) of rider 32 and apply appropriate braking force as rider 32 approaches landing platform 20.

Brake line 40 may be an endless loop entrained around and tensioned between upper reel 50 and lower reel 52. The endless loop may be suspended above main cable 12 in a generally vertical plane, so that the endless loop has a lower cable portion 46 and an upper cable portion 48 which may travel in opposite directions as indicated by arrows 46A, 48A. Brake line 40 may alternatively be oriented in a generally horizontal plane (not shown), such that two side-by-side cable portions thereof may travel in opposite directions. Brake line 40 may be made of a strong rope or stranded steel wire cable, and is preferably inelastic. Upper and lower reels 50, 52, may be rotatably mounted on upper and lower reel frames 51, 53 respectively. Upper and lower reel frames 51, 53 may be mounted on supports 14, 18 or on overheard supports 17, 21 or on other suitable supports.

Figure 8:
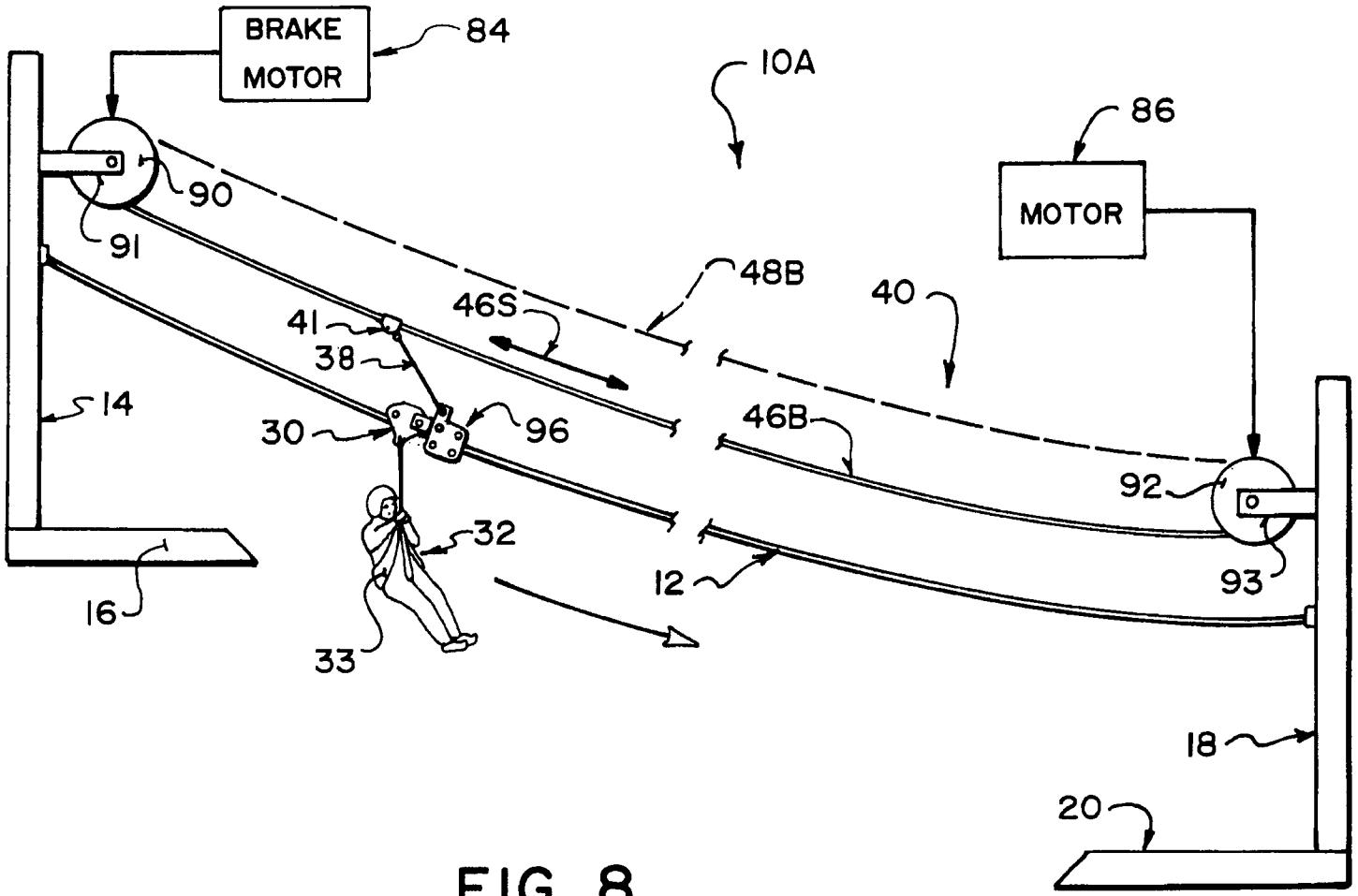
FIG. 8 is similar to FIG. 1, but depicts a shuttle brake line braking and control system.

Brake line 40 need not be an endless loop. For example, as shown in FIG. 8, brake line 40 may be a long cable 46B having terminal ends, each of which is wound around upper reel 90 and lower reel 92 respectively. Upper and lower reels 90, 92 may be rotatably mounted on upper and lower reel frames 91, 93 respectively which may in turn be mounted on supports 14, 18 respectively. Cable 46B is shuttled back and forth between upper and lower reels 90, 92 as indicated by double-headed arrow 46S. Rider 32 is tethered to a point on cable 46B. As rider 32 traverses main cable 12, brake cable 46B is played out from upper reel 90 and taken up by lower reel 92. After rider 32 has finished the traverse, rider 32 is detached from cable 46B and cable 46B is rewound around upper reel 90 (i.e. brake cable 46B is played out from lower reel 92 and taken up by upper reel 90). The return path for cable 46B as it is rewound is depicted as dashed line 48B in FIG. 8. To keep cable 46B taut, a manually-operated or motorized winch can be coupled to either or both of reels 90, 92 to take up any slack in cable 46B as it is played out.

In any of the embodiments described above, at least one of the reels may be braked to slow the reel's rate of rotation and to lock the reel in a stationary position. The braking mechanism can be operated by a zipline operator from a location remote from the braked reel, such as landing platform 20, so that the operator, while standing on landing platform 20, can visually monitor rider 32 throughout the ride and ensure that rider 32 is safely braked upon arrival at landing platform 20. In the endless loop brake line embodiment shown in FIG. 1, a brake is preferably coupled to lower reel 52, but may be coupled to upper reel 50 if desired. In the shuttle brake line embodiment shown in FIG. 8, a brake is coupled to upper reel 90 rather than to lower reel 92 since cable 46B is played out from upper reel 90.

Instead of, or in addition to, braking the reels, brake line 40 itself may be directly braked. For example, a zipline operator may grip brake line 40 with a gloved hand to arrest the motion of brake line 40. As a further example, a brake pad may be pressed against brake line 40 to slow the movement of brake line 40.

To reduce potential slippage of the FIG. 1 endless loop brake line 40, as lower reel 52 is braked, an optional secondary reel 54 may be provided so that brake line 40 may be looped around both lower reel 52 and secondary reel 54. This configuration increases frictional contact between brake line 40 and reels 52, 54.

Figure 2:
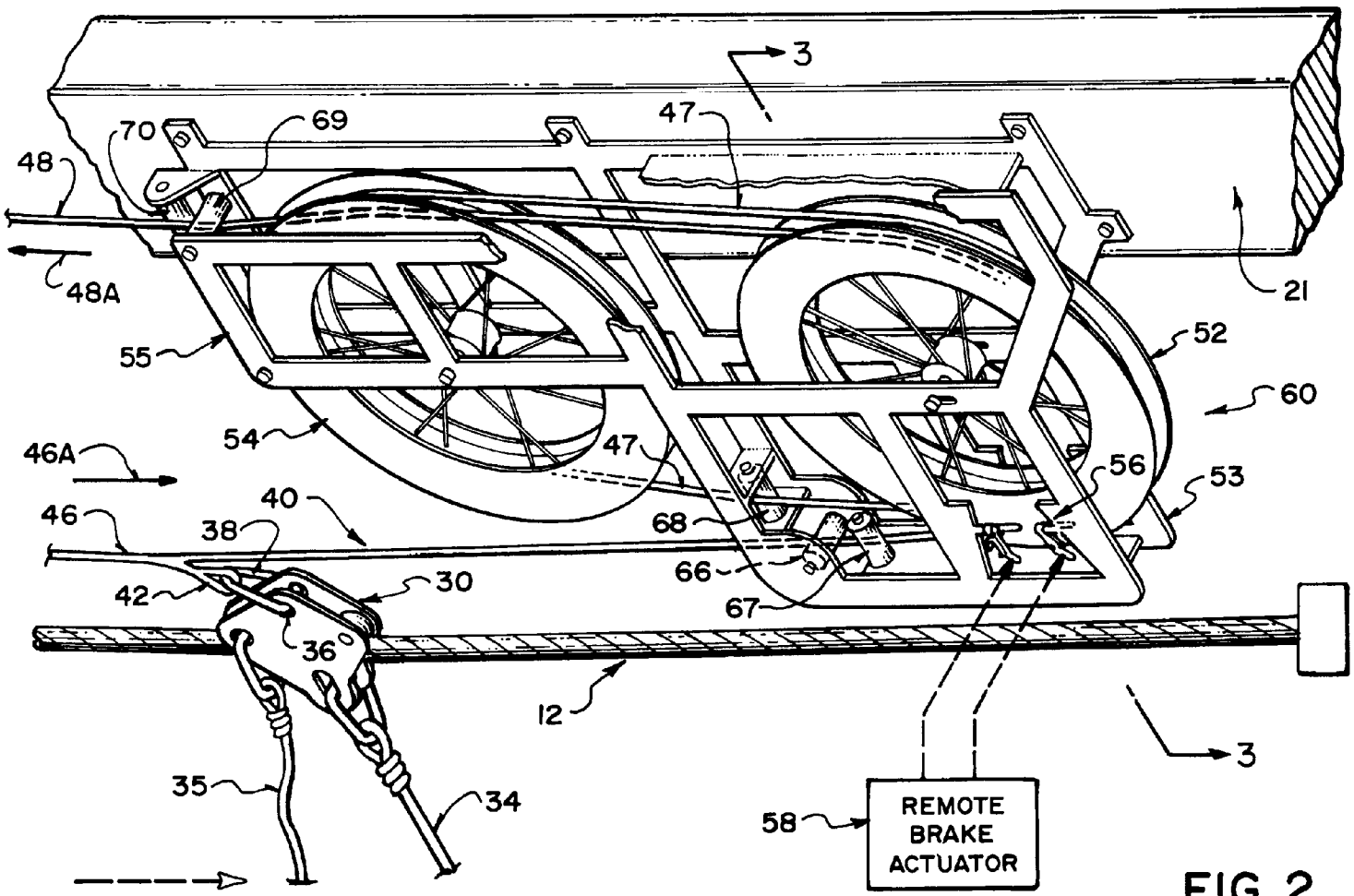
FIG. 2 is a top, oblique, isometric view of a landing platform braking reel assembly.
Figure 3:
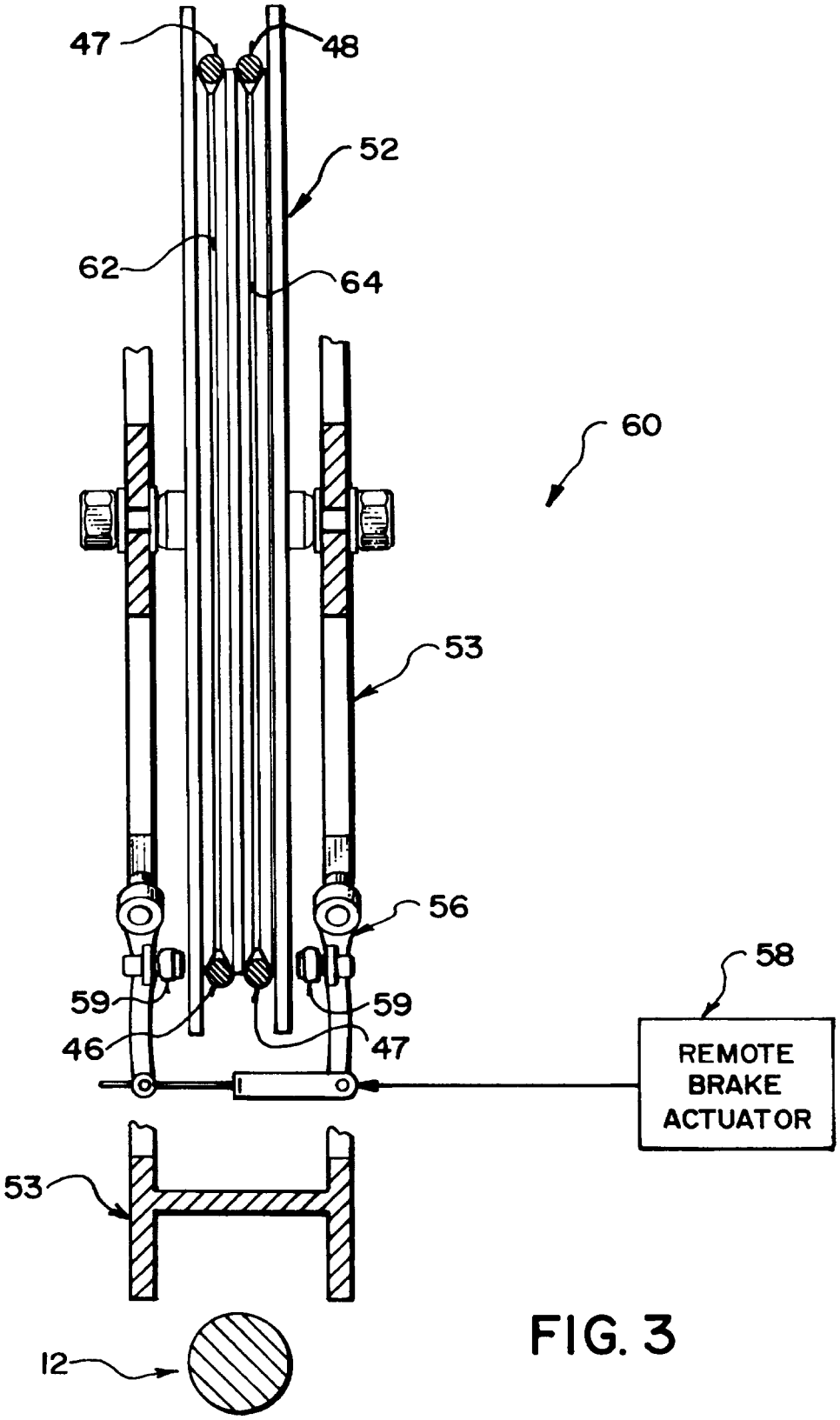
FIG. 3 is a sectional view taken with respect to line 3-3 shown in FIG. 2, with the reel shown in elevation and the frame partially sectioned.

FIGS. 2 and 3 depict a braking reel assembly 60 incorporating lower reel frame 53, lower reel 52 and secondary reel 54. Secondary reel 54 may be rotatably mounted to reel frame 55 for rotation of reel 54 in the same plane as reel 52. Reel 54 may be slightly elevated relative to lower reel 52 as shown, or the axles of reels 52, 54 may be horizontally aligned. As best seen in FIG. 2, lower cable portion 46 of brake line 40, travelling in direction 46A, enters reel frame 53. Intermediate portion 47 of brake line 40 then loops around lower reel 52 and secondary reel 54. Upper cable portion 48 of brake line 40, travelling in direction 48A, then exits reel frame 55. Lower reel 52 and secondary reel 54 may be rotatably interconnected by a chain or a belt (not shown).

Figure 4:
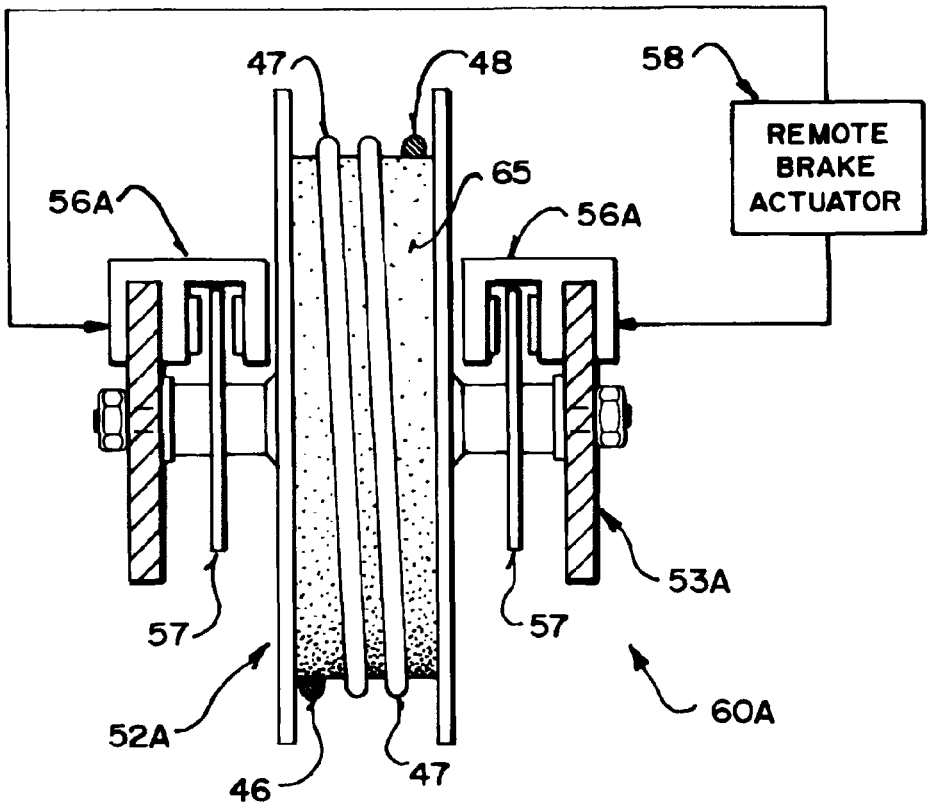
FIG. 4 is an end elevation view of a reel, showing a brake line wrapped around the reel and a brake coupled to the reel.

Other methods or reel configurations may be used to increase frictional contact between brake line 40 and the reels. For example, instead of being looped around reels 52, 54; brake line 40 may be wound multiple times around a single lower reel. FIG. 4 depicts lower reel 52A rotatably mounted on reel frame 53A. Lower cable portion 46 of brake line 40 enters lower reel 52A. Intermediate portion 47 of brake line 40 is then wound twice around lower reel 52A. Upper cable portion 48 of brake line 40 then exits lower reel 52A. Lower reel 52A may have a wide, smooth cylindrical surface 65 to accommodate multiple windings of brake line 40 (i.e. intermediate portion 47). Surface 65 may be coated with rubber, plastic or other material to reduce wear on brake line 40. In addition to, or instead of the above methods, frictional resistance may be provided in the reels' rotational support mechanisms.

A remote brake actuator 58 may be provided to control engagement and disengagement of a brake coupled to a reel. For example, brakes 56 coupled to lower reel 52 may be hydraulically-assisted caliper brakes 59 (FIG. 3) and remote brake actuator 58 may be a hand-operated lever, which can be squeezed by an operator to engage brakes 56 or released to disengage brakes 56, similarly to the braking devices on bicycles. Alternately, brakes 56 may be another kind of brake operable to slow the rate of rotation of lower reel 52, such as disc brakes, magnetic brakes, eddy current brakes, regenerative brakes (electric, gas compression or other), air-resistance fan brakes, or simply the direct application of hand pressure. By way of example, FIG. 4 shows disc brakes 56A which engage disk brake rotors 57 coupled to lower reel 52A. Brakes 56 or 56A may be controlled manually by a zipline operator or automatically by a programmable controller (not shown).

Each reel may have at least one circumferential groove for guiding and positioning brake line 40 on the reel. The groove may be a depression in the reel's outer surface, or a channel between the reel's opposed circumferential flanges. In the embodiment shown in FIG. 1, upper reel 50 may have one circumferential groove, since brake line 40 passes around reel 50 only once. Lower reel 52 and secondary reel 54 may have two laterally-spaced circumferential grooves, since brake line 40 doubles back around reels 52, 54. As seen in FIG. 3, lower reel 52 has a first groove 62 which receives lower cable portion 46 as it enters the reel, and a second groove 64 which guides intermediate cable portion 47 until it exits the reel as upper cable portion 48. If no secondary reel 54 is provided, and if brake line 40 passes around lower reel 52 only once, there may be only one circumferential groove on lower reel 52. If brake line 40 is wound around reel 52A multiple times as shown in FIG. 4, reel 52A may have a smooth ungrooved surface.

Guide rollers may be mounted on the reel frames to align brake line 40 with the reels. For example, FIG. 2 shows a horizontal entry roller 66 and a vertical entry roller 67 for aligning lower cable portion 46 as it enters groove 62 of lower reel 52. Intermediate vertical roller 68 aligns intermediate cable portion 47 as it enters groove 64 of lower reel 52 for entrainment around secondary reel 54. Horizontal exit roller 69 and vertical exit roller 70 align upper cable portion 48 as it exits secondary reel 54. Similarly, horizontal and vertical rollers may be provided to align brake line 40 for entry into a groove provided around upper reel 50, or to align brake line 40 as it enters and exits reel 52A (after wrapping multiple times around reel 52A).

In operation of the embodiments illustrated in FIGS. 1 to 3, reels 50, 52 and 54 are free to rotate and brake line 40 is free to be pulled by pulley block 30 while brakes 56 are disengaged. As gravitational forces cause pulley block 30 and rider 32 to slide forwardly along main cable 12, brake line 40 is pulled forwardly by pulley block 30 since tether 38 couples lower cable portion 46 to pulley block 30. When brakes 56 are engaged, the braking force applied to lower reel 52 slows the rate of rotation of reel 52 which in turn decelerates brake line 40. Consequently, rider 32 decelerates along with brake line 40.

In a typical braking operation, the zipline operator applies braking force to lower reel 52 to decelerate brake line 40. After a period of application of braking force, reel 52 may be brought to a complete stop and locked in a stationary position by brakes 56. This also locks brake line 40 in a stationary position, preventing rider 32 from moving forwardly or rearwardly. The time required to bring rider 32 to a stop depends on several factors including the braking force applied to lower reel 52 and the initial momentum of rider 32.

The braking operation described above may also be used to slow rider 32 without bringing rider 32 to a complete stop. For example, the operator may apply braking force to brakes 56 to slow the rate of rotation of reel 52 such that brake line 40 and rider 32 decelerate to a controlled speed. The operator may subsequently adjust the braking force to maintain rider 32 at the controlled speed, or the operator may partially or completely disengage brakes 56 and allow gravitational forces to accelerate rider 32. Alternatively, rider 32 can be accelerated by suitably controlled operation of a motor drivingly coupled to the reels, as described below.

A safety net 22 (FIG. 1) may be provided at landing platform 20 to catch rider 32 and prevent rider 32 from colliding with landing platform 20 or support 18, should braking and control system 10 fail. Before rider 32 is launched, safety net 22 is raised to a ready position such that net 22 extends transversely across the rider's intended path as indicated by dashed line 24. As rider 32 approaches safety net 22, the zipline operator determines whether rider 32 can be safely braked prior to arrival at landing platform 20. If rider 32 can be safely braked, the operator causes safety net 22 to be lowered as indicated at 26, to allow rider 32 to reach landing platform 20.

A motor 80 may be coupled to one of the reels, such as upper reel 50, to drive the reel. For repositioning purposes, motor 80 may be operated to rotate reel 50, which in turn rotates brake line 40 around the reels. For example, before rider 32 can be launched on the zipline, it may be necessary to reposition brake line 40 so that loop 42 on brake line 40 can be accessed by an operator on platform 16, to enable the operator to couple tether 38 to loop 42. If main cable 12 sags, brake line 40 may have to be repositioned because rider 32 has rolled down to a nadir in main cable 12 and must be pulled forward in order to reach landing platform 20. Motor 80 is optional, since brake line 40 may be repositioned manually by a zipline operator by pulling on brake line 40.

Motor 80 may be a motor/generator. As brake line 40 is pulled along by forward-moving rider 32, causing the reels to rotate, the generator converts the reels' mechanical rotation into electrical energy, which can be stored in battery 82 for subsequently supplying power to motor 80. In some embodiments, a generator may be provided independently of motor 80.

The operation of the FIG. 8 shuttle brake line embodiment is similar to the above-described operation of the FIG. 1 endless loop embodiment. However, in the shuttle brake line embodiment, a brake is coupled to upper reel 90. As brake cable 46B is pulled by forwardly moving rider 32, any slack in brake cable 46B is immediately taken up by lower reel 92. While the brake is disengaged, upper reel 90 is free to rotate and cable 46B is free to be pulled along by rider 32. When the brake is engaged, the braking force applied to upper reel 90 slows the rate of rotation of reel 90, decelerating cable 46B, thereby decelerating rider 32.

As seen in FIG. 8, a motor 86 may be coupled to lower reel 92 to drive lower reel 92 in order to take up the slack in cable 46B as cable 46B is played out from upper reel 90. A motor and brake system 84 may be coupled to upper reel 90 for braking upper reel 90 and for driving upper reel 90 in order to take up the slack in cable 46B as cable 46B is rewound from lower reel 92 onto upper reel 90. Motor 86 and motor and brake system 84 may also be used to drive reels 90, 92 to reposition cable 46B. Motor 86 and motor and brake system 84 may be controlled manually by a zipline operator, or automatically by a control system which detects rotation of one reel and transmits suitable control signals to synchronously rotate the other reel.

As previously indicated, rider 32 may be coupled to brake line 40 by tether 38 which may extend between pulley block 30 and loop 42 fixed on lower cable portion 46, as shown in FIG. 1. Alternately, tether 38 may be secured to harness 33. Tether 38 may be inelastic (e.g. a metal link) or elastic (e.g. a bungee cord).

In the embodiment illustrated in FIG. 2, tether 38 is a carabiner removably fastenable through aperture 36 in pulley block 30 and through loop 42 on brake line 40. Loop 42 may be made of the same material as brake line 40. One or more additional loops may be provided at various locations along brake line 40. This permits rider 32 to be tethered to any one of the multiple loops along brake line 40, reducing the time required to reposition brake line 40 each time a new rider is prepared for launch. For example, rider 32B may be tethered to brake line 40 via loop 44 (FIG. 1). Once rider 32B arrives at landing platform 20, the next rider 32 may be prepared for launch by tethering rider 32 to another loop 42 located near launch platform 16.

Figure 5:
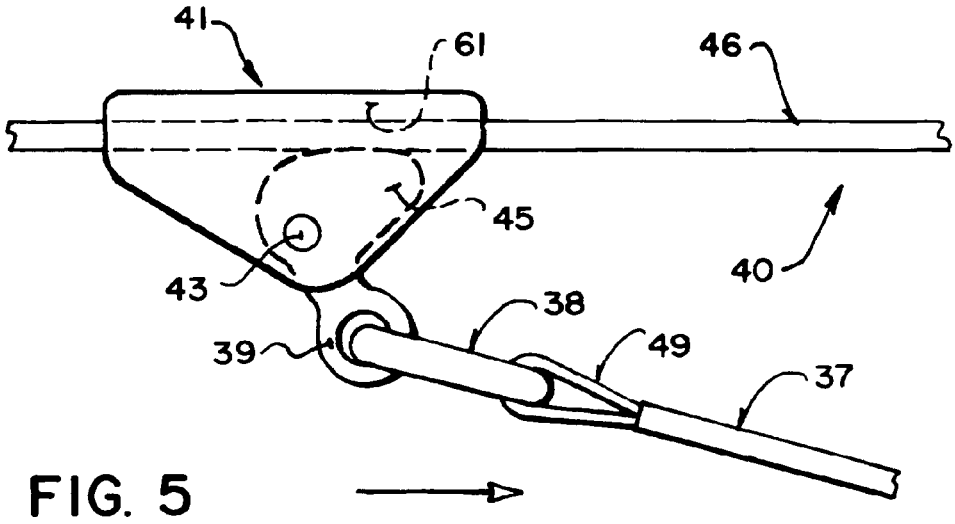
FIG. 5 is a side view of a rope grab gripping a brake line.

Instead of fastening tether 38 to a loop on brake line 40, tether 38 may be fastened to a rope grab which grips brake line 40 at any point therealong. FIG. 5 shows rope grab 41 gripping cable portion 46. Rope grab 41 may be any suitable device capable of clampingly engaging a rope, line or cable such as rope grabs typically used by climbers. In the illustrated embodiment, rope grab 41 has a channel 61 through which cable portion 46 extends. Rope grab 41 is fixed to cable portion 46 by cam 45 which extends within channel 61 and bears against cable portion 46 and the inner side walls of rope grab 41. Pivot pin 43, which extends through the side walls of rope grab 41 and through cam 45, retains cam 45 within channel 61. Tether 38 couples rope grab 41 to rider 32. More particularly, tether 38 may be a carabiner hooked through attachment loop 39 on rope grab 41 and through an attachment loop 49 on an extension 37 which is in turn connected to pulley block 30 or to the rider's harness 33. Extension 37 is optional—tether 38 may be fastened directly to pulley block 30.

Figure 6:
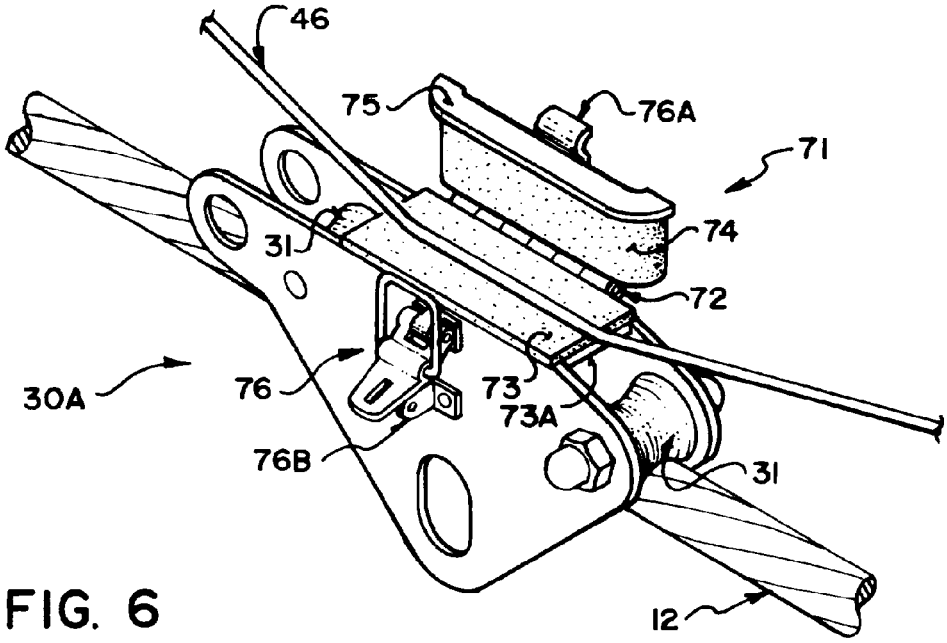
FIG. 6 is a top, oblique, isometric view of a pulley block mounted on a zipline cable, with a clamp on the pulley block for gripping a brake line.

Alternately, rider 32 may be tethered to brake line 40 by a clamp provided on the rider's pulley block. FIG. 6 shows pulley block 30A having rollers 31 rollingly mounted on main cable 12. Clamp 71 is coupled to an upper portion of pulley block 30A for gripping cable portion 46. Clamp 71 has a lower gripping pad 73 and an upper gripping pad 74 joined along one edge by hinge 72. Lower gripping pad 73 is supported by grip support plate 73A fastened to pulley block 30A. Cable portion 46 extends between gripping pads 73, 74 (shown apart, in an open position). Clamp 71 also includes a latch 76, a latch receiver 76A, and a locking tab 76B, for locking gripping pads 73, 74 together in a closed position. The unhinged outside edge of upper gripping pad 74 may have a flange 75 to prevent cable portion 46 from slipping out from between gripping pads 73, 74. For enhanced gripping power, the surfaces of gripping pads 73, 74 which contact cable portion 46 may be covered with rubber or other elastically deformable material, or a rough material.

Variations to the above clamping arrangement are possible while still fixing rider 32 to a point on brake line 40. For example, clamp 71 may be integrally formed with pulley block 30A, or may be a separate piece which can be tethered to pulley block 30A or harness 33.

Figure 7:
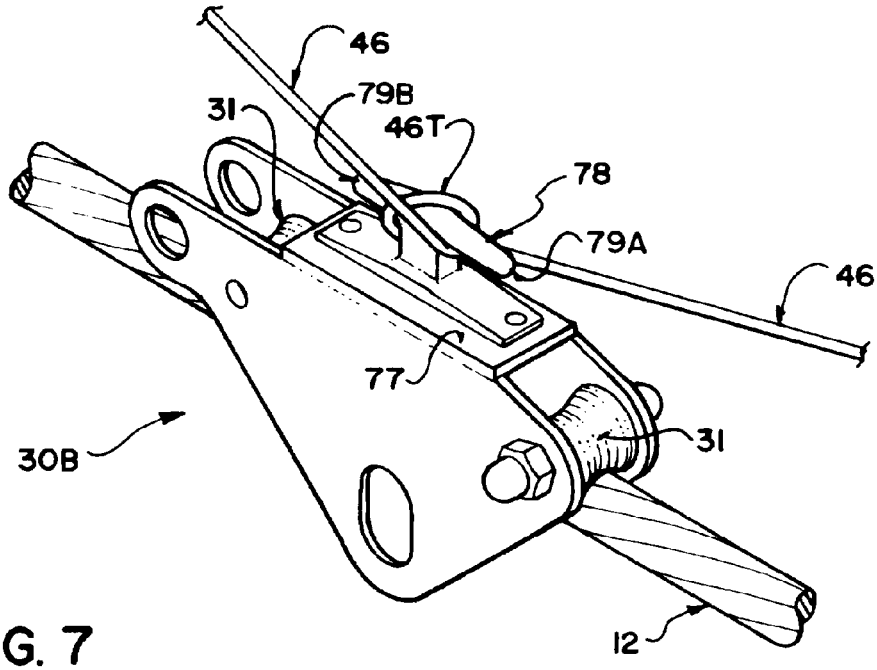
FIG. 7 is a top, oblique, isometric view of a pulley block mounted on a zipline cable, with a cleat on the pulley block for engaging a brake line.

In another embodiment shown in FIG. 7, pulley block 30B is secured to a point on brake line 40 by cleat 78 which has forwardly and rearwardly projecting horns 79A, 79B fixed to base plate 77 fastened on pulley block 30B. Segment 46T of cable portion 46 is looped around horns 79A, 79B thereby frictionally engaging cable portion 46 with pulley block 30B to prevent forward or rearward movement of pulley block 30B with respect to cable portion 46.

Instead of tethering brake line 40 to a pulley block or to the rider's harness, brake line 40 may be tethered to a braking block mounted on main cable 12. As seen in FIG. 8, tether 38 extends between braking block 96 mounted on main cable 12 and rope grab 41 grippingly engaging brake line 40. Pulley block 30 slides forwardly along main cable 12 until it engages and is releasably coupled to braking block 96. Pulley block 30 and braking block 96 then slide together along main cable 12, with rider 32 thereby tethered to brake line 40. By controlling the speed of brake line 40, a zipline operator may also control the speed of pulley block 30 and braking block 96. After rider 32 arrives at landing platform 20, pulley block 30 is detached from braking block 96, and braking block 96 along with tether 38 and rope grab 41 are repositioned so that braking block 96 is ready to receive the next rider.

Braking and control system 10 may be used in combination with other braking mechanisms. For example, prior to launch of rider 32, a braking block may be mounted on main cable 12 near platform 20, and pulley block 30 may be tethered to brake line 40 in any manner described above. A zipline operator may thereafter slow rider 32 to a desired speed prior to pulley block 30 engaging with the braking block.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. Apparatus for braking a zipline rider traversing a main cable, the zipline rider suspended beneath a rider block moveably mountable to the main cable, the apparatus comprising:

a brake line extending generally parallel to a substantial portion of the main cable, the brake line entrained around first and second reels respectively rotatably mounted near opposed ends of the main cable;

a brake coupled to at least one of the reels and operable to slow and arrest rotation of the at least one of the reels; and a tether couplable between the zipline rider and the brake line;

wherein:

the brake line comprises an endless loop rotatably supported by the first and second reels;

the brake is coupled to the second reel, the second reel located near a lower end of the main cable;

the first reel comprises a first circumferential groove for receiving the brake line and the second reel comprises a second circumferential groove for receiving the brake line;

the first reel is rotatably supported near an upper end of the main cable; and the second reel is rotatably supported near the lower end of the main cable;

the apparatus further comprising: a first guide mounted near the second reel, the first guide for guiding the brake line into the second circumferential groove of the second reel and a second guide mounted near the first reel, the second guide for guiding the brake line into the first circumferential groove of the first reel;

wherein:

the first guide comprises a first vertical guide roller and a first horizontal guide roller; and the second guide comprises a second vertical guide roller and a second horizontal guide roller.

2. Apparatus as defined in claim 1, wherein the tether comprises one or more components which couple the brake line to the rider block.

3. Apparatus as defined in claim 2, wherein the one or more components comprise a carabiner.

4. Apparatus as defined in claim 2, wherein the tether is couplable to the brake line at one of a plurality of points along the brake line.

5. Apparatus as defined in claim 2, wherein the one or more components comprise a rope grab releasably fastenable to the brake line.

6. Apparatus for braking a zipline rider traversing a main cable, the zipline rider suspended beneath a rider block moveably mountable to the main cable, the apparatus comprising:

a brake line extending generally parallel to a substantial portion of the main cable, the brake line entrained around first and second reels respectively rotatably mounted near opposed ends of the main cable;

a brake coupled to at least one of the reels and operable to slow and arrest rotation of the at least one of the reels; and a tether couplable between the zipline rider and the brake line wherein:

the brake line comprises an endless loop rotatably supported by the first and second reels;

the brake is coupled to the second reel, the second reel located near a lower end of the main cable;

the first reel is rotatably supported near an upper end of the main cable;

the second reel is rotatably supported near the lower end of the main cable;

the apparatus further comprises a third reel rotatably supported near the second reel for entrainment of an intermediate portion of the brake line around the second and third reels;

the first reel comprises a first circumferential groove for receiving the brake line, the second reel comprises a second circumferential groove for receiving the brake line and the third reel comprises a third circumferential groove for receiving the brake line;

the apparatus further comprises a first guide mounted near the second reel, the first guide for guiding the brake line into the second circumferential groove of the second reel; and the apparatus further comprises a second guide mounted near the third reel, the second guide for guiding the brake line into the third circumferential groove of the third reel.

7. Apparatus as defined in claim 6, further comprising a third guide mounted near the first reel, the third guide for guiding the brake line into the first circumferential groove of the first reel.

8. Apparatus as defined in claim 7, wherein:

the first guide comprises a first vertical guide roller and a first horizontal guide roller;

the second guide comprises a second vertical guide roller and a second horizontal guide roller; and the third guide comprises a third vertical guide roller and a third horizontal guide roller.

9. Apparatus for braking a zipline rider traversing a main cable that extends between a launch platform and a landing platform, the zipline rider suspended beneath a rider block moveably mountable to the main cable, the apparatus comprising:

a brake line extending generally parallel to a substantial portion of the main cable, the brake line entrained around first and second reels respectively rotatably mounted near opposed ends of the main cable, the first reel rotatably mounted at a first location more proximate to the launch platform than to the landing platform and the second reel rotatably mounted at a second location more proximate to the landing platform than to the launch platform;

a brake coupled to at least one of the reels and operable to slow and arrest rotation of the at least one of the reels; and a tether couplable between the zipline rider and the brake line;

wherein the tether comprises one or more components which couple the brake line to a wearable harness.

10. Apparatus for braking a zipline rider traversing a main cable that extends between a launch platform and a landing platform, the zipline rider suspended beneath a rider block moveably mountable to the main cable, the apparatus comprising:

a brake line extending generally parallel to a substantial portion of the main cable, the brake line entrained around first and second reels respectively rotatably mounted near opposed ends of the main cable, the first reel rotatably mounted at a first location more proximate to the launch platform than to the landing platform and the second reel rotatably mounted at a second location more proximate to the landing platform than to the launch platform;

a brake coupled to at least one of the reels and operable to slow and arrest rotation of the at least one of the reels; and a tether couplable between the zipline rider and the brake line;

wherein the tether comprises one or more components which couple the brake line to the rider block; and wherein the one or more components comprise a loop fixed to the brake line and one or more links coupled between the loop and the rider block.

11. Apparatus as defined in claim 10, the brake line comprising an endless loop rotatably supported by the first and second reels.

12. Apparatus according to claim 11 wherein the endless loop:

is oriented in a generally vertical plane; and comprises upper and lower portions movable in opposed directions in the generally vertical plane, the upper and lower portions extending between the first and second reels which are horizontally spaced apart from one another.

13. Apparatus as defined in claim 12, wherein the brake line is above the main cable, and the tether is couplable to the lower portion of the brake line.

14. Apparatus as defined in claim 11, wherein the brake is coupled to the second reel.

15. Apparatus as defined in claim 14, wherein the brake comprises a pair of brake calipers.

16. Apparatus as defined in claim 15, wherein the brake calipers are hydraulically actuated.

17. Apparatus as defined in claim 14, wherein the first reel comprises a first circumferential groove for receiving the brake line and the second reel comprises a second circumferential groove for receiving the brake line.

18. Apparatus according to claim 17 wherein:

the first reel is rotatably supported near an upper end of the main cable; and the second reel is rotatably supported near the lower end of the main cable;

the apparatus further comprising a first guide mounted near the second reel, the first guide for guiding the brake line into the second circumferential groove of the second reel.

19. Apparatus as defined in claim 18, further comprising a second guide mounted near the first reel, the second guide for guiding the brake line into the first circumferential groove of the first reel.

20. Apparatus as defined in claim 14, further comprising a third reel rotatably supported near the second reel for entrainment of an intermediate portion of the brake line around the second and third reels.

21. Apparatus as defined in claim 20, wherein the first reel comprises a first circumferential groove for receiving the brake line, the second reel comprises a second circumferential groove for receiving the brake line and the third reel comprises a third circumferential groove for receiving the brake line.

22. Apparatus as defined in claim 10, wherein the brake is controllable by an operator from a location remote from the brake.

23. Apparatus according to claim 10 comprising a motor drivingly coupled to at least one of the reels for driving the at least one of the reels to reposition the brake line.

24. Apparatus for braking a zipline rider traversing a main cable that extends between a launch platform and a landing platform, the zipline rider suspended beneath a rider block moveably mountable to the main cable, the apparatus comprising:

a brake line extending generally parallel to a substantial portion of the main cable, the brake line entrained around first and second reels respectively rotatably mounted near opposed ends of the main cable, the first reel rotatably mounted at a first location more proximate to the launch platform than to the landing platform and the second reel rotatably mounted at a second location more proximate to the landing platform than to the launch platform;

a brake coupled to at least one of the reels and operable to slow and arrest rotation of the at least one of the reels; and a tether couplable between the zipline rider and the brake line;

wherein the tether comprises one or more components which couple the brake line to the rider block; and wherein the one or more components comprise a plurality of loops fixed to the brake line at spaced intervals and one or more links coupleable between any one of the loops and the rider block.

25. Apparatus for braking a zipline rider traversing a main cable, the zipline rider suspended beneath a rider block moveably mountable to the main cable, the apparatus comprising:

a brake line extending generally parallel to a substantial portion of the main cable, the brake line entrained around first and second reels respectively rotatably mounted near opposed ends of the main cable;

a brake coupled to at least one of the reels and operable to slow and arrest rotation of the at least one of the reels; and a tether couplable between the zipline rider and the brake line wherein the tether comprises a cleat fixed to the rider block; and the brake line frictionally engages the cleat.

26. Apparatus, for braking a zipline rider traversing a main cable, the zipline rider suspended beneath a rider block moveably mountable to the main cable, the apparatus comprising:

a brake line extending generally parallel to a substantial portion of the main cable, the brake line entrained around first and second reels respectively rotatably mounted near opposed ends of the main cable;

a brake coupled to at least one of the reels and operable to slow and arrest rotation of the at least one of the reels; and a tether couplable between the zipline rider and the brake line;

wherein:

the brake line comprises an endless loop rotatably supported by the first and second reels; and the apparatus further comprises: a motor drivingly coupled to at least one of the reels for driving the at least one of the reels to reposition the brake line; a battery electrically connected to the motor; and a dynamo drivingly coupled to at least one of the reels for converting kinetic energy of the at least one of the reels to electrical energy for storage in the battery.

27. Apparatus for braking a zipline rider traversing a main cable, the zipline rider suspended beneath a rider block moveably mountable to the main cable, the apparatus comprising:

a brake line extending generally parallel to a substantial portion of the main cable, the brake line entrained around first and second reels respectively rotatably mounted near opposed ends of the main cable;

a brake coupled to at least one of the reels and operable to slow and arrest rotation of the at least one of the reels; and a clamp on the rider block for clampingly engaging the brake line.

28. Apparatus for braking a zipline rider traversing a main cable that extends between a launch platform and a landing platform, the zipline rider suspended beneath a rider block moveably mountable to the main cable, the apparatus comprising:

a brake line extending generally parallel to a substantial portion of the main cable, the brake line entrained around first and second reels respectively rotatably mounted near opposed ends of the main cable, the first reel rotatably mounted at a first location more proximate to the launch platform than to the landing platform and the second reel rotatably mounted at a second location more proximate to the landing platform than to the launch platform;

a brake coupled to at least one of the reels and operable to slow and arrest rotation of the at least one of the reels; and a braking block mounted on the main cable to releasably engage the rider block, the braking block tethered to the brake line.

29. A method for braking a zipline rider traversing a main cable from a launch area to a landing area, the zipline rider suspended beneath a rider block moveable mountable to the main cable, the method comprising:

extending a brake line generally parallel to a substantial portion of the main cable from a first location more proximate to the launch area than to the landing area to a second location more proximate to the landing area than to the launch area;

tethering the brake line to at least one of: a wearable harness and the rider block; and decelerating the brake line to slow and arrest motion of the zipline rider.

30. A method as defined in claim 29, further comprising entraining the brake line around first and second reels, the first reel rotatably mounted at the first location and the second reel rotatably mounted at the second location.

31. A method as defined in claim 30, wherein the brake line further comprises an endless loop.

32. A method as defined in claim 31, wherein decelerating the brake line further comprises decelerating the second reel.

33. A method as defined in claim 32, wherein decelerating the second reel further comprises manual control of the deceleration by an operator from a location remote from the brake.

34. A method as defined in claim 30, further comprising drivingly rotating at least one of the reels to reposition the brake line on the reels.

35. A method as defined in claim 34, further comprising converting kinetic energy of at least one of the reels to electrical energy and storing the electrical energy to power a motor drivingly coupled to at least one of the reels.

36. A method as defined in claim 29, wherein tethering the brake line to at least one of: the wearable harness and the rider block further comprises coupling one or more tether components between the rider block and the brake line.

37. A method as defined in claim 29, wherein tethering the brake line to at least one of: the wearable harness and the rider block further comprises coupling one or more tether components between the brake line and the wearable harness.

38. A method as defined in claim 29, wherein tethering the brake line to at least one of: the wearable harness and the rider block further comprises clamping the rider block to the brake line.

39. A method as defined in claim 29, wherein tethering the brake line to at least one of: the wearable harness and the rider block further comprises removably fastening a carabiner between the rider block and a loop on the brake line.

40. A method as defined in claim 29, wherein tethering the brake line to at least one of: the wearable harness and the rider block further comprises coupling one or more tether components between the rider block and the brake line, the one or more tether components comprising a rope grab gripping the brake line.

41. A method as defined in claim 29, wherein tethering the brake line to at least one of: the wearable harness and the rider block further comprises providing a cleat on the rider block and frictionally engaging the brake line with the cleat.

42. A method as defined in claim 29, wherein decelerating the brake line further comprises manual control of the deceleration by an operator from a location remote from the brake.

* * * * *